US011850877B2

(12) United States Patent
Schmitt-Lewen et al.

(10) Patent No.: US 11,850,877 B2
(45) Date of Patent: Dec. 26, 2023

(54) PRINTING METHOD WITH TRANSFER OF A BARRIER LAYER FOR PRODUCING HIGH GLOSS PRINTED PRODUCTS

(71) Applicant: Heidelberger Druckmaschinen AG, Heidelberg (DE)

(72) Inventors: Martin Schmitt-Lewen, Heidelberg (DE); Heike Gute, Darmstadt (DE); Thorsten Euler, Darmstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 143 days.

(21) Appl. No.: 17/176,463

(22) Filed: Feb. 16, 2021

(65) Prior Publication Data

US 2021/0252895 A1 Aug. 19, 2021

(30) Foreign Application Priority Data

Feb. 19, 2020 (DE) ..... 102020104330.9

(51) Int. Cl.
*B41M 7/00* (2006.01)
*B41M 5/00* (2006.01)

(52) U.S. Cl.
CPC ..... *B41M 7/0027* (2013.01); *B41M 5/0017* (2013.01); *B41M 7/009* (2013.01); *B41M 7/0036* (2013.01)

(58) Field of Classification Search
CPC B41M 7/0027; B41M 7/0036; B41M 5/0017; B41M 7/009
See application file for complete search history.

(56) References Cited

U.S. PATENT DOCUMENTS

| | | | | |
|---|---|---|---|---|
| 6,880,457 | B2 | 4/2005 | Roesch et al. | |
| 8,960,087 | B2 | 2/2015 | Preisner et al. | |
| 9,266,361 | B2 | 2/2016 | Plaia et al. | |
| 9,573,359 | B2 | 2/2017 | Fergen et al. | |
| 10,252,549 | B2 | 4/2019 | Hachmann et al. | |
| 2003/0207052 | A1* | 11/2003 | Niu | B41M 5/52 428/32.38 |
| 2004/0206260 | A1* | 10/2004 | Pitz | B41F 23/0413 101/424.1 |
| 2006/0230965 | A1* | 10/2006 | Thal | B41M 7/02 101/483 |

(Continued)

FOREIGN PATENT DOCUMENTS

| | | | |
|---|---|---|---|
| CN | 1545448 | A | 11/2004 |
| CN | 1895892 | A | 1/2007 |

(Continued)

*Primary Examiner* — Justin Seo
*Assistant Examiner* — Kendrick X Liu
(74) *Attorney, Agent, or Firm* — Laurence A. Greenberg; Werner H. Stemer; Ralph E. Locher

(57) ABSTRACT

A printed product is produced by providing a substrate, producing at least one interlayer on the substrate, printing a printed image onto the interlayer, and forming a barrier layer on the printed image. The barrier layer is provided on the printed image by applying a barrier composition to at least one carrier, at least partially drying the barrier layer and transferring it to the printed image. Preferred substrates have an acidic precoat layer as an interlayer. Such substrates can then be varnished with glossy varnishes, to achieve particularly high gloss values.

6 Claims, 2 Drawing Sheets

(56) References Cited

U.S. PATENT DOCUMENTS

| | | | | |
|---|---|---|---|---|
| 2007/0012209 | A1 | 1/2007 | Ichimura | |
| 2007/0218254 | A1 | 9/2007 | Zhou et al. | |
| 2014/0109782 | A1* | 4/2014 | Fergen | B41F 19/002 101/217 |
| 2018/0134047 | A1 | 5/2018 | Paul et al. | |
| 2018/0312717 | A1* | 11/2018 | Niu | D21H 19/24 |
| 2022/0267622 | A1* | 8/2022 | Spitteler | C09D 11/03 |

FOREIGN PATENT DOCUMENTS

| | | | |
|---|---|---|---|
| CN | 102642439 | A | 8/2012 |
| CN | 104582964 | A | 4/2015 |
| CN | 107433790 | A | 12/2017 |
| DE | 102013016117 | A1 | 5/2014 |
| DE | 102014222677 | A1 | 6/2015 |
| DE | 102015211553 | A1 | 2/2016 |
| DE | 102017208404 | A1 | 1/2018 |
| DE | 102017213226 | A1 | 3/2018 |
| EP | 1700694 | A2 | 9/2006 |
| WO | 2015198736 | A1 | 12/2015 |

* cited by examiner

PRINTING METHOD WITH TRANSFER OF A BARRIER LAYER FOR PRODUCING HIGH GLOSS PRINTED PRODUCTS

CROSS-REFERENCE TO RELATED APPLICATION

This application claims the priority, under 35 U.S.C. § 119, of German patent application DE 10 2020 104 330.9, filed Feb. 19, 2020; the prior application is herewith incorporated by reference in its entirety.

BACKGROUND OF THE INVENTION

Field of the Invention

This invention relates to a method for producing a printed product and the use of a barrier layer on an acidic precoat layer, to increase the gloss of a layer of varnish applied over the barrier layer.

It is possible to print a plurality of different substrates printed with modern printing presses, to produce printed products for a multitude of applications. A growing market for printed products is the production of printed packaging. These are required in large quantities for the packaging of various goods, such as, for example, cosmetics or foodstuffs. Many printed products, such as, for example, in packaging printing, are produced today by inkjet printing methods. Traditionally, using inkjet printing heads of the printing press, inkjet inks are thereby applied on the substrate, such as, for example, paper or cardboard, and subsequently, depending on the inkjet inks used, traditionally dried thermally or by means of the action of UV radiation. For improvement of the visual appearance of the printed products, in particular in the case of seemingly high-value packaging, the printed product is often varnished in a subsequent step in the printing press with a glossy varnish.

Since the print quality is generally not satisfactory when printing directly on the substrate with inkjet ink, a precoat layer is usually first applied to the substrate in the printing press before printing with the inkjet ink. This improves the print quality, especially the definition of the printing dots, on the substrate.

The precoat coatings traditionally used in inkjet printing methods generally have an acidic pH value. This proves to be a disadvantage during final varnishing with the glossy varnish, the gloss values of which are then not satisfactory. This disadvantage is particularly pronounced if a water-based varnish is used for the final varnishing. If an acidic precoat layer is printed with inkjet ink and then finally varnished with a water-based varnish, only moderate gloss values are obtained.

Commonly assigned German published patent application DE 10 2014 222 677 A1 describes a method for taking impressions of microstructures in which a fluid wraps around a mold mounted at least in sections on a cylinder and the fluid is thermally acted upon during the wrapping method. This publication, substantially, only deals with the taking of impressions of embossed structures.

Commonly assigned German published patent application DE 10 2013 016 117 A1 and its counterpart U.S. Pat. No. 9,573,359 B2 deal with a method and a device for generating and transferring diffractive microstructures on a printing substrate in a printing press. The publication also describes a method in which a liquid is applied to an embossing cylinder, where it is solidified and transferred to a printing substrate. Those publication, substantially, only deal with the production of printing substrates with microstructures.

BRIEF SUMMARY OF THE INVENTION

There is still a need for methods that can be used when using acidic precoats to produce printed products that are printed with inkjet inks and varnished with high gloss values. Such methods should be compatible with traditional precoats, inkjet inks, and varnishes, and should be feasible for execution in conventional printing presses.

Surprisingly, it was found that printed products with high gloss values of the varnish that is used can be obtained by applying an at least partially dried barrier layer to the precoat printed with inkjet ink before the varnishing.

With the above and other objects in view there is provided, in accordance with the invention, a method of producing a printed product, the method comprises the following steps:

i) providing a substrate;

ii) applying an interlayer composition to the substrate and drying the interlayer composition to obtain an interlayer on the substrate;

iii) printing a printed image on the interlayer using at least one printing medium and drying the image to form a dried printed image;

iv) providing an at least partially dried barrier layer on the dried printed image by applying a barrier composition to a support, drying the barrier composition at least partially, and transferring the at least partially dried barrier layer to the dried printed image.

The barrier layer is produced by drying a composition on at least one support, for example, a printing press cylinder. The barrier layer is then transferred to the precoat printed with inkjet inks. The barrier layer is transferred in particular in a film-like form. As a consequence, the barrier layer is not produced directly on the coated substrate by application of liquid with subsequent drying, but rather separately from it on at least one support from which the solid barrier layer produced is transferred to the coated substrate.

The method according to the invention is associated with several advantages. In the method according to the invention, printed products with high gloss values are obtained. The method according to the invention can advantageously be carried out in printing presses. Since the at least partially dried barrier layer can be produced and transferred with minimal thickness, printed products can be obtained whose thickness and weight are only slightly changed despite the additional layer. The haptics of the printed products obtained are practically unchanged.

Presumably, the separate production of the barrier layer on the support, with subsequent transfer in at least partially dried form onto the printed acidic precoat, means that, in contrast with the direct application and drying on the printed acidic precoat, the finally applied coating is better shielded from the acidic precoat layer.

DESCRIPTION OF THE INVENTION

Figure 1:
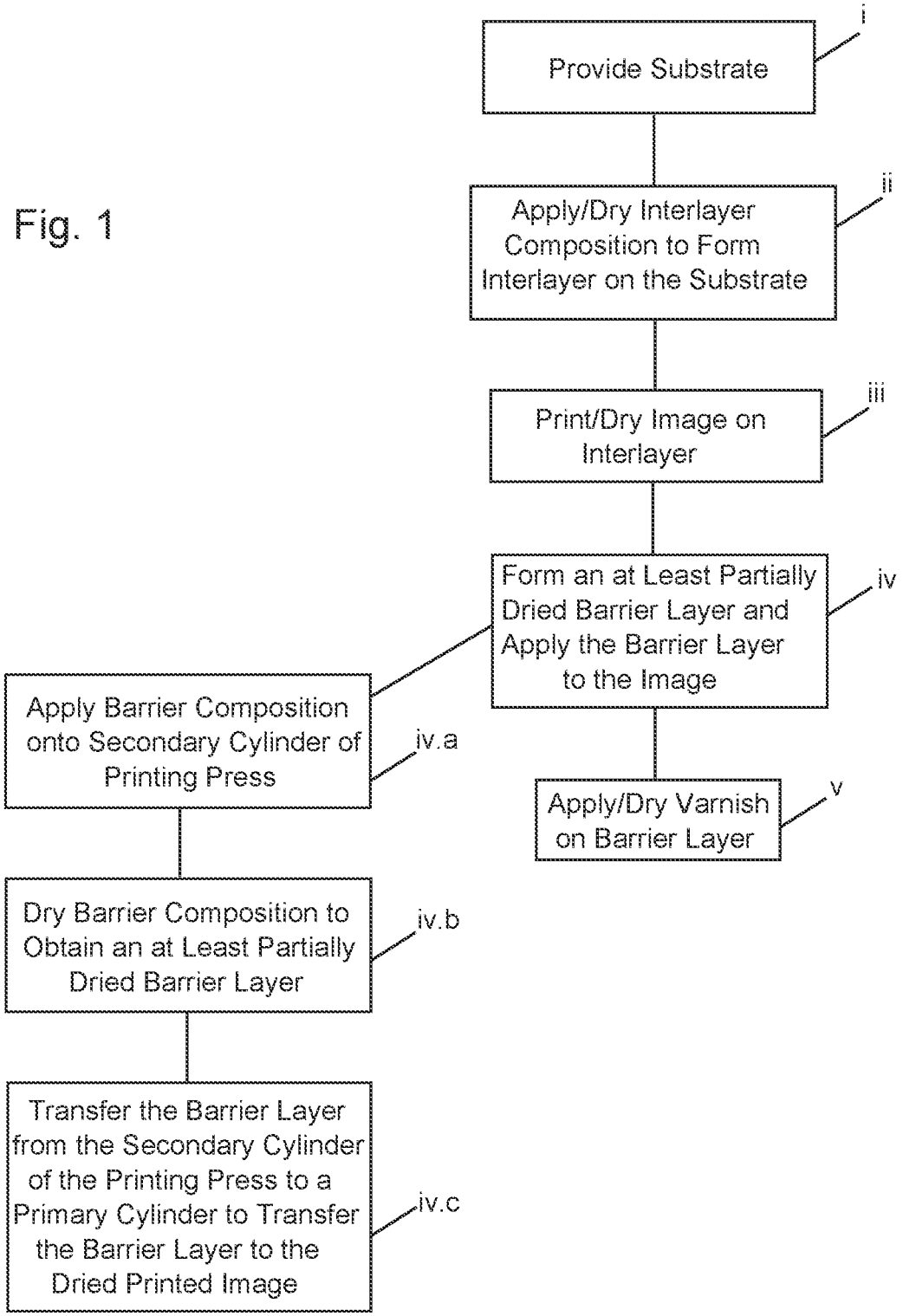
FIG. 1 shows a flow chart illustrating the method according to the invention.
Figure 2:
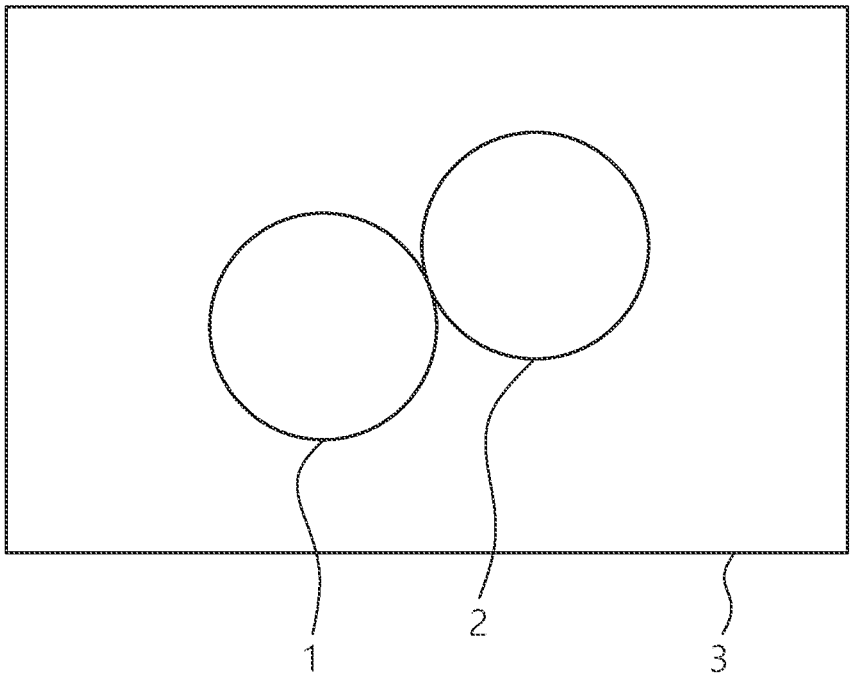
FIG. 2 shows a schematic representation of a printing press.

Referring now to the FIGURE of the drawing in detail, the invention relates to a method for producing a printed product, in which i) a substrate is provided, ii) at least one interlayer composition is applied to the substrate and dried to obtain an interlayer on the substrate, iii) a printed image using at least one printing medium is printed on the interlayer and dried; and iv) an at least partially dried barrier layer is provided on the dried printed image.

In step iv), the at least partially dried barrier layer is provided on the dried printed image by applying a barrier composition to at least one support, drying it at least partially and transferring it to the dried printed image.

In principle, all materials which can be coated are suitable as substrates for step i). Substrates that are preferred are those which can be processed in printing presses. Particularly preferred substrates are those selected from plastics, paper, and cardboard.

In step ii), at least one interlayer composition is applied onto the substrate, dried, and an interlayer is thus obtained on the substrate. In principle, all types of compositions, preferably liquid compositions, are suitable as interlayer compositions, which, after a drying operation, lead to a solid layer on the substrate, preferably on the substrates mentioned as particularly preferred. Preferred interlayer compositions are those that can be dried thermally, by UV radiation, by electron radiation, or combinations thereof.

Preferred interlayer compositions are selected from precoats for inkjet inks, particularly preferably precoats for water-based inkjet inks. Such precoats are, in principle, known to those of skill in the pertinent art.

In a preferred embodiment, the interlayer obtained after drying has an acidic pH value. In this embodiment, an interlayer composition having an acidic pH value is preferably applied in step ii).

The interlayer composition can be applied in step ii) by methods known in principle from the prior art. Preferred methods are selected from printing, particularly preferably offset printing, flexographic printing, screen printing or inkjet printing, spraying, doctoring, coating, dipping and combinations thereof. Most preferably, the interlayer composition is applied in step ii) using a flexographic printing method.

In a preferred embodiment of the invention, the drying of the interlayer composition in step ii) is performed thermally, by the action of UV radiation, by the action of electron radiation, or combinations thereof. Suitable heat sources for thermal drying include hot air blowers or infrared lamps. Suitable UV radiation sources for drying by UV radiation include UV lamps.

In step iii), a printed image is printed onto the interlayer using at least one printing medium and the interlayer is dried. In principle, all printing methods known in the prior art are suitable as printing methods, with offset printing methods, flexographic printing methods, screen printing methods, inkjet printing methods and combinations thereof being preferred. Inkjet printing methods are particularly preferred.

In principle, all printing media in the prior art suitable for the respective printing methods, in particular those mentioned as preferred, are suitable as printing media. These can be dried in step iii) by methods known in principle from the prior art, preferably thermally, under the action of UV radiation, under the action of electron radiation, or combinations thereof.

In a particularly preferred embodiment, the printed image is printed in step iii) by means of inkjet printing. In this embodiment, the printing medium is preferably selected from water-based inkjet inks and UV inkjet inks, with water-based inkjet inks being particularly preferred.

The printed image printed in step iii) may be full-surface, i.e. a continuous layer without recesses, or may have one or more free areas, i.e. unprinted areas. It may, for example, be a grid of repeating image units.

In step iv) of the method according to the invention, an at least partially dried barrier layer is provided on the dried printed image obtained in step iii). For this purpose, according to the invention, a barrier composition is applied to at least one support, this barrier composition is at least partially dried onto the at least one support, and the at least partially dried barrier composition is transferred to the dried printed image as an at least partially dried barrier layer.

In a preferred embodiment, the barrier composition is selected from pasty and liquid compositions. It is particularly preferred that the barrier composition is liquid.

The barrier composition is converted into an at least partially dried barrier layer by at least partial drying. Preferably, in step iv), the at least partially dried barrier layer is transferred in film-like form from the at least one support onto the dried printed image. Preferred drying methods for at least partially drying the barrier composition include thermal drying, drying by UV radiation, drying by electron radiation, and combinations thereof. Thermal drying is particularly preferred as a drying method. In this preferred embodiment, drying is performed, for example, by supplying hot air or by irradiating with infrared radiation using an infrared lamp.

In principle, all compositions known in the art, which can be converted by at least partial drying into an at least partially dried layer that can be transferred to the dried printed image are suitable as barrier compositions. Preferred barrier compositions are those that can be at least partially dried by thermal drying, by UV radiation, by electron radiation, or by combinations thereof. Preferred barrier compositions are selected from thermally drying compositions, particularly preferably thermally drying inks, paints and varnishes, and most preferably thermally drying varnishes.

In a preferred embodiment, the barrier composition is selected from water-based compositions that can be thermally dried. In a particularly preferred embodiment, the barrier composition comprises at least one water-based varnish that can be thermally dried.

Suitable as the at least one support is, in principle, any type of device capable of removably receiving and transferring an at least partially dried layer to the dried printed image, excluding the printed substrate itself. Preferably, the at least one carrier is selected from printing unit cylinders of a printing press.

In a particular embodiment, in step iv), the at least partially dried barrier layer is provided on the dried printed image by a method comprising the following steps:

a) application of a barrier composition onto a secondary cylinder 2 of a printing press 3, b) at least partial drying of the barrier composition on the secondary cylinder 2 of the printing press 3 to obtain an at least partially dried barrier layer on the secondary cylinder 2 of the printing press 3, and c) transferring the at least partially dried barrier layer from the secondary cylinder 2 of the printing press 1 to a primary cylinder 1 of the printing press, which transfers the at least partially dried barrier layer to the dried printed image.

In this particular embodiment, the preferred barrier composition and printed image are those mentioned herein as preferred. The secondary cylinder is understood to be a cylinder of the printing press that is different from the primary cylinder, which transfers the at least partially dried barrier layer onto the dried printed image. The secondary cylinder may, for example, be the plate cylinder of an offset printing unit and the primary cylinder may be the blanket cylinder of the offset printing unit.

In a preferred embodiment, the method according to the invention comprises a step v) following step iv), in which at least one varnish is applied to the at least partially dried barrier layer and dried. The at least one coating can be applied by methods known in principle in the prior art, for example, by printing, particularly preferably offset printing methods, flexographic printing methods, screen printing methods or inkjet printing methods, spraying, doctoring, painting, dipping or combinations thereof. The at least one applied coating can be dried by methods that are known in principle in the prior art, for example, thermally, with UV radiation or electron radiation.

Glossy coatings are preferred as coatings for step v), especially preferably those with high gloss values. In a particularly preferred embodiment, a glossy coating selected from water-based coatings is applied in step v). Water-based coatings are known in principle in the prior art. Such varnishes contain water and dry thermally under the action of heat, the water contained in the varnish being substantially removed during the drying process. Suitable heat sources for thermal drying include, for example, hot air blowers or infrared lamps.

Another aspect of this invention relates to the use of an at least partially dried layer of at least one water-based varnish as a barrier layer on an acidic precoat layer printed with water-based inkjet ink, wherein the at least partially dried layer of the at least one water-based varnish is prepared without contact with the acidic precoat layer to increase the gloss of a varnish layer applied over the barrier layer.

By using the method according to the invention, printed products comprising acidic precoat coatings can be coated with conventional glossy coatings in printing presses to obtain printed products with high gloss values.

EXAMPLES

Example 1

A printed product is produced in a printing press according to the method of the invention, the underlying substrate having an acidic precoat layer. After the transfer of the dried barrier layer, the printed product was coated with a water-based dispersion varnish. As a result, gloss values, measured according to ISO 2813 with a measuring geometry of 60°, of about 50 to 65 gloss units were obtained.

Comparative Example

A printed product was produced as in example 1, but without a barrier layer. Gloss values of about 30 to 45 gloss units, measured using the same method as in example 1, were obtained as a result.

The invention claimed is:

1. A method of producing a printed product, the method comprising:

i) providing a substrate;

ii) applying an interlayer composition to the substrate and drying the interlayer composition to obtain an interlayer on the substrate, wherein the interlayer has an acidic pH value;

iii) printing a printed image on the interlayer using at least one printing medium and drying the image to form a dried printed image;

iv) providing an at least partially dried barrier layer on the dried printed image by, a) applying the barrier composition to a support, the support being a secondary cylinder of a printing press, b) at least partially drying the barrier composition on the secondary cylinder of the printing press to obtain the at least partially dried barrier layer on the secondary cylinder of the printing press, and c) transferring the at least partially dried barrier layer from the secondary cylinder of the printing press to a primary cylinder of the printing press, to thereby transfer the at least partially dried barrier layer to the dried printed image; and v) applying varnish to the at least partially dried barrier layer and drying the varnish.

2. The method according to claim 1, wherein the barrier composition is a liquid or pasty composition.

3. The method according to claim 1, wherein the barrier composition comprises at least one water-based varnish.

4. The method according to claim 1, wherein the at least one interlayer composition is selected from precoats for water-based inkjet inks.

5. The method according to claim 1, wherein the at least one printing medium is selected from water-based inkjet inks.

6. The method according to claim 1, wherein the support is a printing unit cylinder of a printing press.

* * * * *